US011318514B2

(12) United States Patent
Galli et al.

(10) Patent No.: US 11,318,514 B2
(45) Date of Patent: May 3, 2022

(54) PRESS FOR THE DIRECT EXTRUSION OF METALLIC MATERIAL

(71) Applicant: Danieli & C. Officine Meccaniche S.P.A., Buttrio (IT)

(72) Inventors: Alessandro Mario Galli, Costa Masnaga (IT); Mattia Merlini, Brescia (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 206 days.

(21) Appl. No.: 16/721,369

(22) Filed: Dec. 19, 2019

(65) Prior Publication Data

US 2020/0197994 A1 Jun. 25, 2020

(30) Foreign Application Priority Data

Dec. 21, 2018 (IT) ..... 102018000020782

(51) Int. Cl.
*B21C 23/04* (2006.01)
*B21C 23/21* (2006.01)

(52) U.S. Cl.
CPC ..... *B21C 23/215* (2013.01)

(58) Field of Classification Search
CPC ..... B21C 23/04; B21C 23/212; B21C 23/214; B21C 23/215; B21C 27/00
See application file for complete search history.

(56) References Cited

U.S. PATENT DOCUMENTS 3,070,391 A * 12/1962 Hofmann ..... B21C 23/212 403/18
3,431,765 A * 3/1969 Lombard ..... B21C 23/212 72/255
3,802,238 A * 4/1974 Grant ..... B21C 23/212 72/43
9,649,680 B2 * 5/2017 Frehe ..... B21C 23/212
2005/0252267 A1 * 11/2005 Gala ..... B21C 23/212 72/272

FOREIGN PATENT DOCUMENTS

EP 0379932 A2 8/1990
EP 0589240 A1 3/1994
(Continued)

OTHER PUBLICATIONS

Translation JP06-170438A, Tomita et al. Jun. 21, 1994.*

*Primary Examiner* — Edward T Tolan
(74) *Attorney, Agent, or Firm* — Stetina Brunda Garred and Brucker

(57) ABSTRACT

The present invent on relates to a press for the direct extrusion of metallic material. The press comprises a supporting structure, a container receiving the metallic material to be extruded, a container holder element and a plurality of adjustment devices to adjust the position of the container holder with respect to the supporting structure. The container holder element is movable along an extrusion direction by means of a plurality of pads slidable along corresponding guides integral with the supporting structure. The press comprises at least one motorized member operationally connected to at least one of the adjustment devices to determine a variation of the position of the container holder with respect to the supporting structure.

12 Claims, 8 Drawing Sheets

(56) References Cited

FOREIGN PATENT DOCUMENTS

| | | | |
|---|---|---|---|
| JP | H06170438 | | 6/1994 |
| JP | 2004025287 | A | 1/2004 |
| JP | 2017002912 | A | 1/2017 |
| WO | 9621527 | A1 | 7/1996 |
| WO | 2014191967 | A1 | 12/2014 |

* cited by examiner

PRESS FOR THE DIRECT EXTRUSION OF METALLIC MATERIAL

FIELD OF THE INVENTION

The present invention relates to the manufacturing of items made of metallic material, either ferrous or non-ferrous, which may be aluminum section bars, for instance. In particular, the invention relates to a press for the direct extrusion of section bars of metallic material.

BACKGROUND ART

The use of an extrusion press is known for making metallic material section bars. In this regard, FIG. 1 shows an extrusion press (100) of known type which comprises a supporting structure defined by two crosspieces (110,120), a front one and a rear one, connected by means of columns (130), typically four in number. A die (M) is positioned at the front crosspiece (110), which confers the shape to the section bar to be extruded.

The material to be extruded, is pushed through the die (M) by means of a thrust cylinder (C) integrated into the rear crosspiece, in a position substantially opposite to the die. The rear crosspiece (120) is typically anchored to the ground, while the front crosspiece (110) is arranged on a slide so that the forces are transferred to the rear crosspiece through the columns indicated above instead of being relieved onto the ground (foundation).

The raw material to be extruded is typically in the form of a cylindrical billet (see FIG. 2). The billet is loaded into a container consisting of a hollow cylindrical body of significant thickness. In turn, the container is placed inside a container holder element (150) (or simply container holder) defining a cavity (155) in which the container is stably housed. An annular insulating body (158) is typically placed between the container and the container holder.

The material is extruded by means of the action of a push rod pushed by the cylinder (C) indicated above. In particular, the push rod is movable between two extreme positions which define its stroke along an extrusion direction (105). The push rod comprises a free end at which a punch, which, acts directly on the billet, is mounted.

In order to allow the loading of the material, the container holder (150) is, in turn, movable between a first position and a second position considered along the extrusion direction. At the first position, the container holder is spaced from the die by a distance greater than the length of the billet to be extruded. In this condition, the billet to be extruded can be loaded into the press. In particular, by means of loading means, e.g. motorized, arms, the billet is positioned against the die and maintained in this condition by means of the punch of the push rod which, by internally crossing the container, applies a force onto the end of the billet opposite to the one in contact with the die. Successively, the container holder is advanced along the extrusion direction to the second reference position, at which the entire billet will be comprised inside the container.

Typically, the container holder is moved by means of moving cylinders (145) which operate independently from the thrust cylinder (C). During the extrusion, these moving cylinders keep the container holder element (150) in the second position defined above and the push rod pushes the material through the container cavity in the extrusion direction.

Again with reference to FIG. 2, the container holder (150) moves between the two reference positions by means of pads or shoes (160) (usually bronze-coated or alternatively of the recirculating ball or needle roller type) which slide along guides (165) (made of hardened and ground steel) fixed to the machine structure. In particular, the sliding pads (160) support the weight of the container holder element and any other accessories installed on the element itself. As shown in FIG. 2, in some solutions the pads (160) comprise abutment elements (161) which define the side position (i.e. according to a direction orthogonal to the extrusion direction lying on a plane which is also orthogonal to the extrusion direction) of the container holder with respect to the extrusion direction.

The punch of the rod has a diameter substantially corresponding to that of the billet to be extruded. Furthermore, the difference between the diameter of the container and the diameter of the punch is very small to prevent the material from being extruded in a direction contrary to that of motion of the rod.

In order to carry out a correct extrusion, it is essential to ensure perfect alignment between the die, the container holder and the rod. These components must be aligned along the extrusion axis. Should this alignment fail, during the step of extruding, the billet would slide against the wall of the container causing the accumulation of material. Therefore, the quality of the extruded profile would be compromised.

In the known solutions, adjustment devices are used to guarantee such an alignment, the devices allowing, as a whole, the position of the container holder to be adjusted according to all the degrees of freedom granted thereto. Typically, these adjustment devices are operated manually and are interposed between the sliding pads and the container holder element in order to vary the position of the container holder (150) with respect to the guides (165) of the sliding blocks (160) fixed to the press structure. With reference to FIG. 3, the adjustment devices typically comprise a screw (170) which crosses a through-cavity (177) extending through a side portion (176) of the container holder element (150) to screw onto a lower body (169) which rests on one of the pads (160). The screw (170) is screwed into a threaded cavity of a bushing (178), which, in turn, is screwed into a threaded portion of the through cavity (177). A lock nut (172) is screwed about the screw (170) and rests on the upper surface of the bushing (178) so as to be opposed to the lower body (169). A rotation of the screw (170), determined manually by an operator, causes a variation in the height of the element of the side portion (176) of the container holder (150) with respect to the pad (150) and thus with respect to the guide on which the pad slides. At the end of the rotation, the lock nut (172) is tightened to prevent unwanted screw movements (170). As a whole, by intervening independently on the four adjustment devices, the operators adjust the spatial position of the container holder (and therefore of the container placed in it). More precisely, the angular deviation (yaw, roll, pitch) of the container axis from the extrusion direction is corrected.

Due to the mechanical wear of the sliding pads and the geometrical variations which may occur during the operation of the press, the container moves with respect to the optimal position, considering the latter as the one in which the axis of the container is aligned with the extrusion direction. As a result of these phenomena, at regular intervals, it is necessary to adjust the position of the container holder, and thus of the container, by acting on the adjustment devices indicated above.

In the most recent solutions, sensors installed on the container holder which detect the position of the container in relation to the sliding guides are provided. The sensors are connected to a control unit which signals the need to realign the container when the deviation from the optimal position becomes unacceptable for a correct extrusion process.

The alignment/adjustment operation is in any case manual and is affected by several to disadvantages, the first of which is the interruption of production for relatively long periods of time. Furthermore, the operation is also critical in terms of safety. Indeed, in order to be implemented, it requires the presence of operators close to the machine and to its components which have a relatively high temperature due to the extrusion process.

Examples of presses according to the prior art comprising solutions, for adjusting the position of the container holder are known from WO 2014/191967, EP 0589240 and WO 96/21527.

SUMMARY OF THE INVENTION

In view of the above considerations, it is the main task of the present invention to provide a press for the extrusion of metal materials which makes it possible to overcome, or at least strongly limit, the drawbacks of the prior art described above. In the scope of this task, it is, therefore, a first object to provide a press in which the adjustment of the position of the container holder can be implemented in an extremely short time. It is a further object of the present invention to provide a press in which the position of the container holder is adjusted in conditions of total safety for the operators. It is a not last object of the present invention to provide a press in which the position can be adjusted precisely and reliably.

The present invention is based on the consideration that the aforesaid objects can be effectively achieved by means of an automated activation of the adjustment devices, i.e. obtained by using motorized members operationally associated with the adjustment devices and preferably controlled by means of a control unit.

In particular, the present invention relates to a press for the direct extrusion of metallic material according to claim 1, particular embodiments of the press according to the present invention being defined by the dependent claims.

In the present application there is also described a press equipped with:

- a supporting structure which defines an extrusion direction of said metal material;
- a container receiving the metal material to be extruded;
- a container holder element which supports said container wherein said container to holder element is movable along said extrusion direction by means of a plurality of pads slidable along corresponding guides integral with the supporting structure;
- a plurality of adjustment devices for adjusting the position of said container holder element with respect to said supporting structure.

The described press is characterized in that it comprises at least one motorized member operatively connected to at least one, of said adjustment devices, wherein in an activating condition, said motorized member activates said at least one adjustment device so as to cause a variation of the position of said container holder element with respect to said supporting structure and wherein, in a deactivating condition, it intervenes on said at least one adjustment device locking it in a configuration previously reached at the end of said activation.

According to a preferred embodiment, the press comprises sensor means which detect the position of said container holder element with respect to said supporting structure. The press further comprises, a control unit which controls said motorized members.

Even more preferably, the press comprises a plurality of motorized members, each one operationally connected to a corresponding one of said adjustment devices. In particular, the sensor means and motorized members are electrically connected to the control unit and the control unit controls. i.e. activates and deactivates, the motorized means according to the position detected by said sensor means.

The use of motorized components makes the operation of adjusting the position of the container holder substantially automated, which in this manner may be done in a very short time and with a much greater frequency than that allowed by the manual adjustment performed on presses of the known type. The automation of the adjustment process further has undoubted advantages in terms of safety, because it no longer requires the direct intervention of the operators.

According to a possible embodiment, the adjustment devices are operationally interposed between a corresponding pad of said plurality of pads and the container holder so that each one of them defines a supporting point for the container holder on a corresponding one of said pads.

According to a possible embodiment, the press comprises a first pad and a second pad sliding along a first and a second guide, respectively. The plurality of adjustment devices comprises a first group of adjustment devices operationally interposed between the first pad and a first side portion of the container holder and a second group of adjustment devices operationally interposed between the second pad and a second side portion of the container holder, wherein the guides are specular with respect to a vertical reference plane containing said extrusion, axis, and wherein the side portions of said container holder are defined by parts opposite to said vertical reference plane.

Preferably, said adjustment devices ref said first group are arranged in a specular position, with respect to said vertical reference plane, to the adjustment devices of said second group.

According to a possible embodiment, at least one of the adjustment devices comprises:

- a lower body slidably inserted in a through cavity defined by a portion of said container holder, in which one end protrudes from the through cavity for resting on a pad;
- an adjustment screw integral with the lower body, wherein said screw is screwed, either directly or indirectly, to a threaded portion of said through cavity so that, as a result of the resting on said pad, a rotation of said adjustment screw determines a displacement of said portion of said container holder along a direction parallel to the axis of said adjustment screw, wherein said at least one motorized member is connected to said adjustment screw to turn it about its axis.

According to a possible embodiment, said at least one motorized member comprises a gearmotor having irreversible behavior; alternatively, said at least one motorized member comprises a gearmotor having reversible behavior equipped with a parking brake. According to a further alternative, said motorized member comprises an irreversible gearmotor provided with a parking brake.

According to another aspect, the press comprises a plurality of lifting devices for to applying a force to said container holder so as to avoid its weight from weighing entirely on said adjustment devices during the activation thereof.

In a possible embodiment, a first group of devices is provided operationally associated with a first side portion of the container holder and a second group of devices is provided operationally associated with a second side portion of the container holder; the side portions of the container holder are defined by parts opposite to a vertical reference plane containing the extrusion axis and the lifting devices of the first group are placed in a position specular to that of the lifting devices of the second group with respect to such a vertical reference plane.

In a possible embodiment, a lifting device comprises a hydraulic cylinder which moves e piston between a resting position and a working position, wherein upon the activation of said lifting device, said piston reaches said working position applying a reaction force to a pad of said plurality of pads which force reduces the weight of the container holder weighing on said adjustment devices.

According to a further embodiment, the press comprises further adjustment means to adjust the position of said container holder along a direction orthogonal to a vertical reference plane comprising said extrusion axis. Preferably, the press comprises further motorized members operationally connected to said further adjustment means for their activation.

BRIEF DESCRIPTION OF THE FIGURES

Further features and advantages of the present invention will be apparent in light of the detailed description of preferred, but not exclusive, embodiments of a press for the extrusion of metallic material according to the present invention as illustrated by way of non-limiting example, with the aid of the accompanying drawings, in which.

In Figures from 5 to 8, the same reference numerals and letters are used to identify the same elements or components.

DETAILED DESCRIPTION OF THE INVENTION

Figure 1:
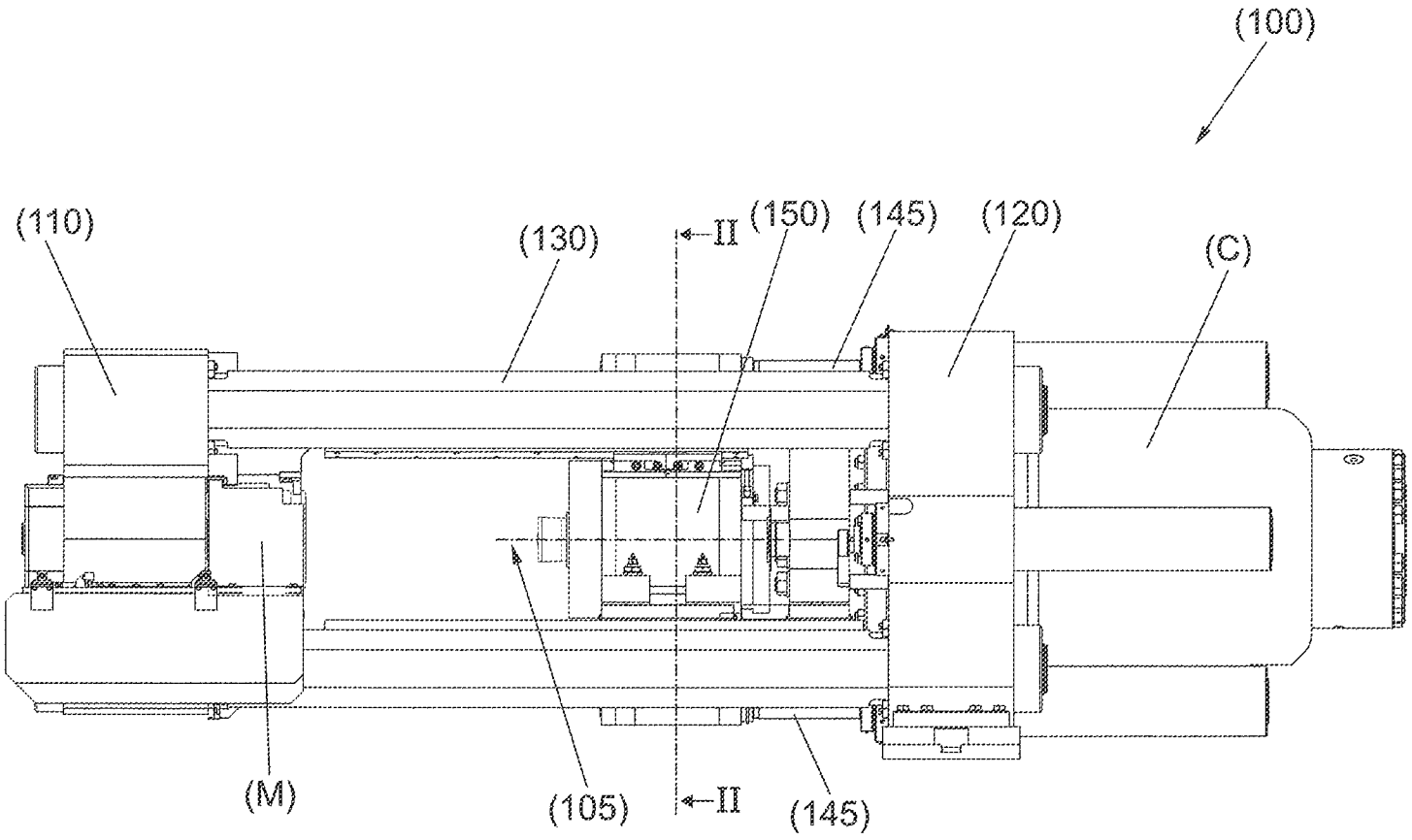
FIG. 1 is a view of an adjustment device of the position of a container holder of a press of known type.
Figure 2:
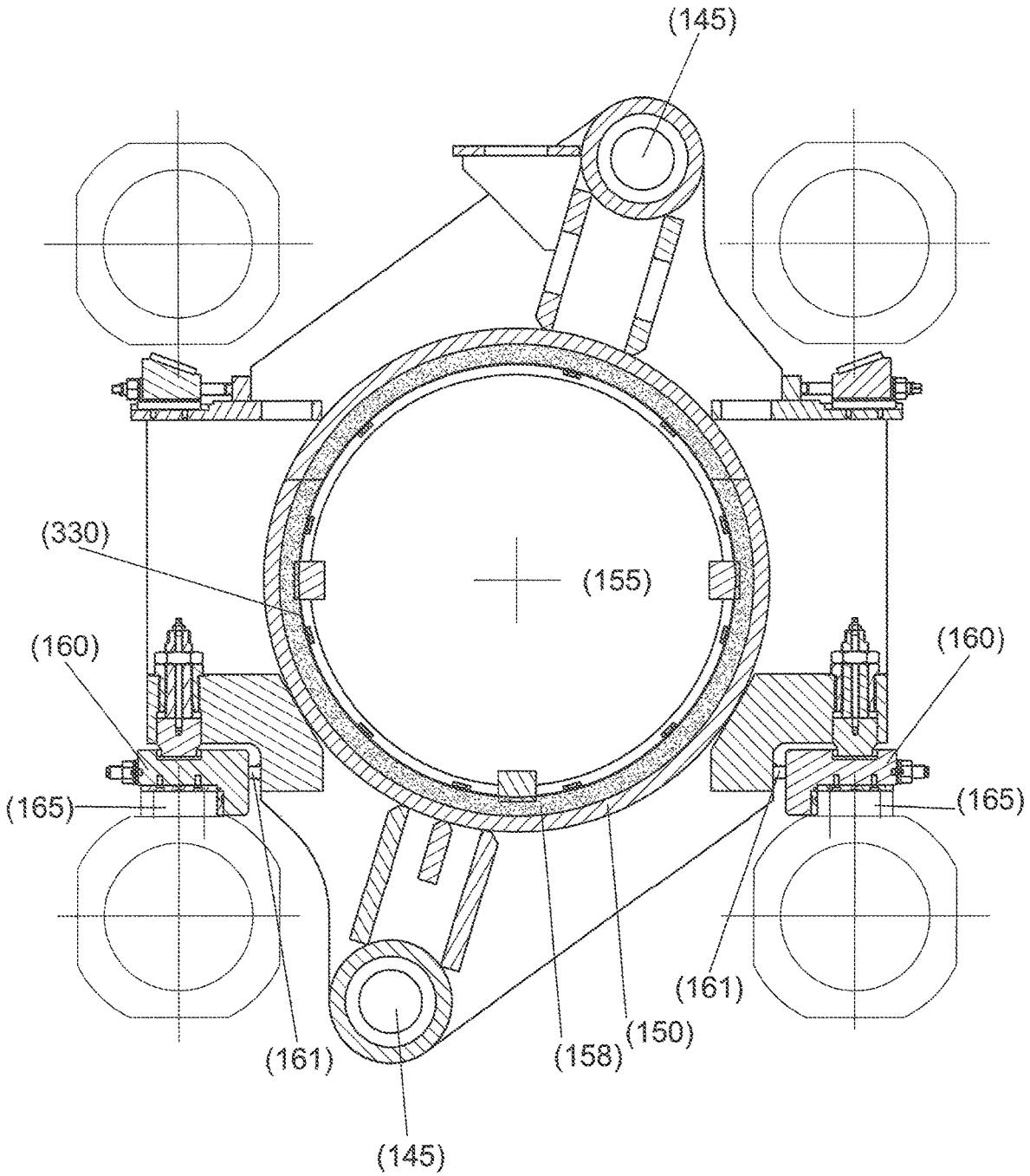
FIG. 2 is a section view taken along section plane in FIG. 1.
Figure 3:
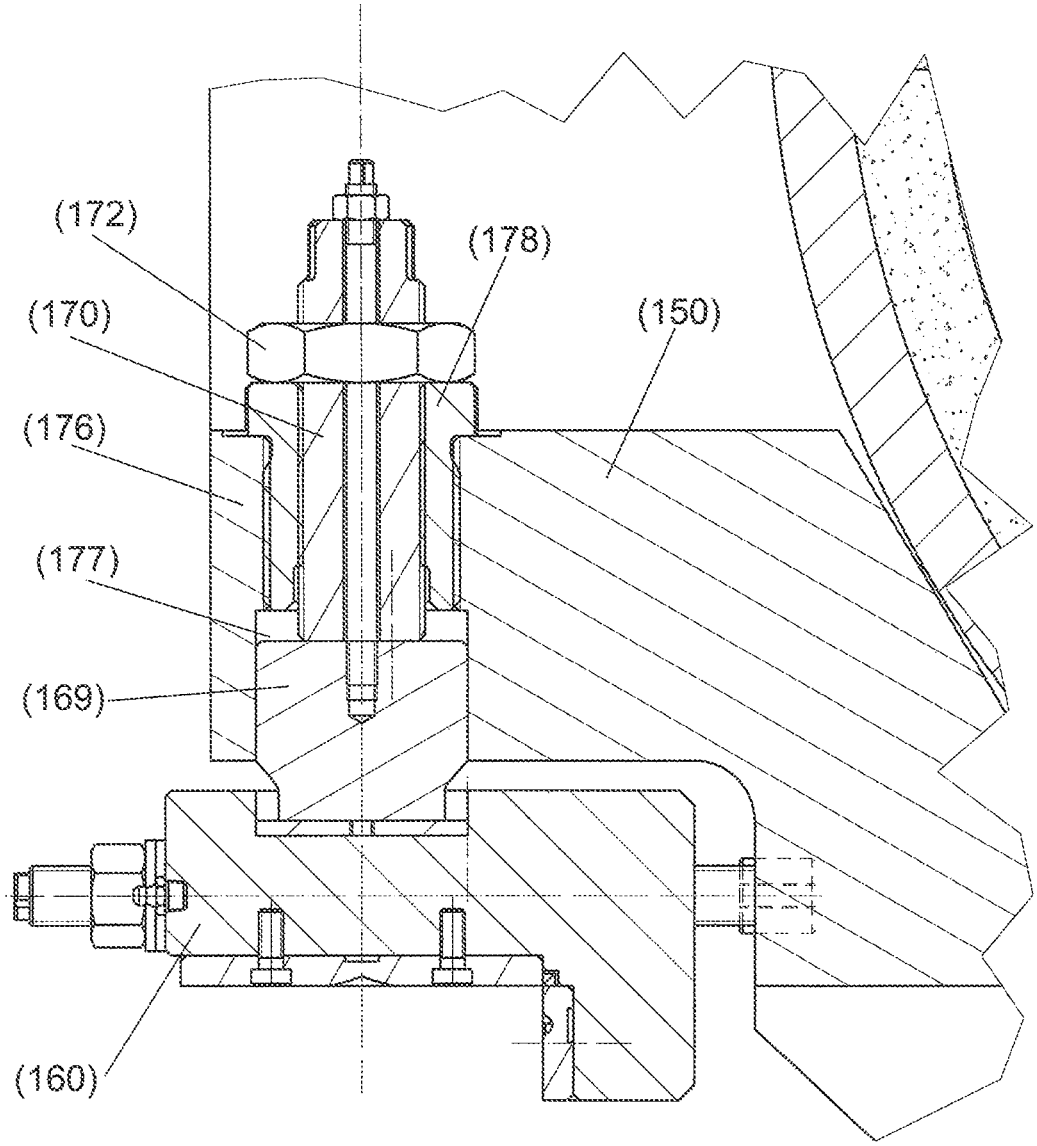
FIG. 3 is a detailed view of some components of the press in FIG. 1.
Figure 4:
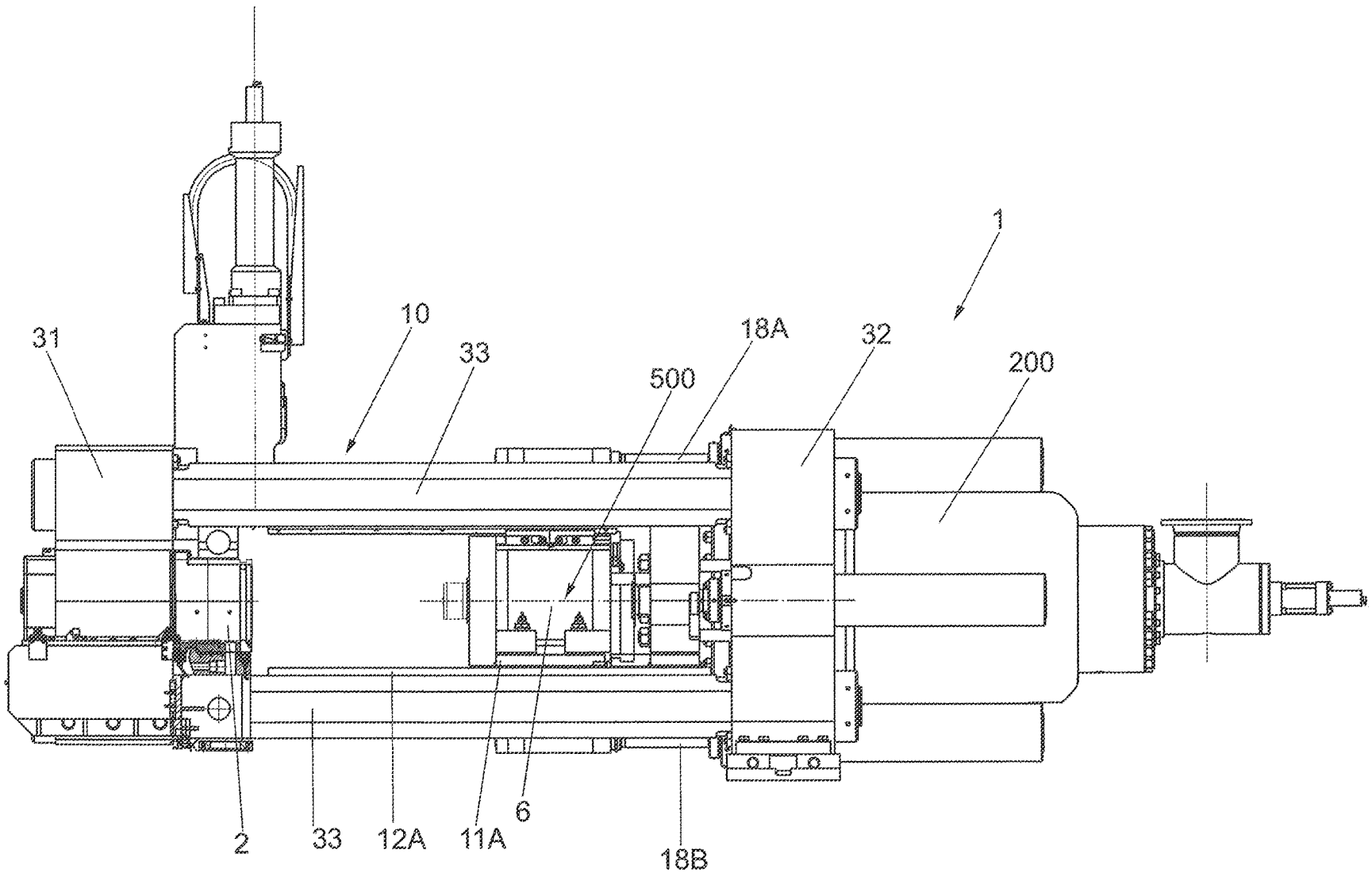
FIG. 4 is a plan view of a press according to the present invention.
Figure 5:
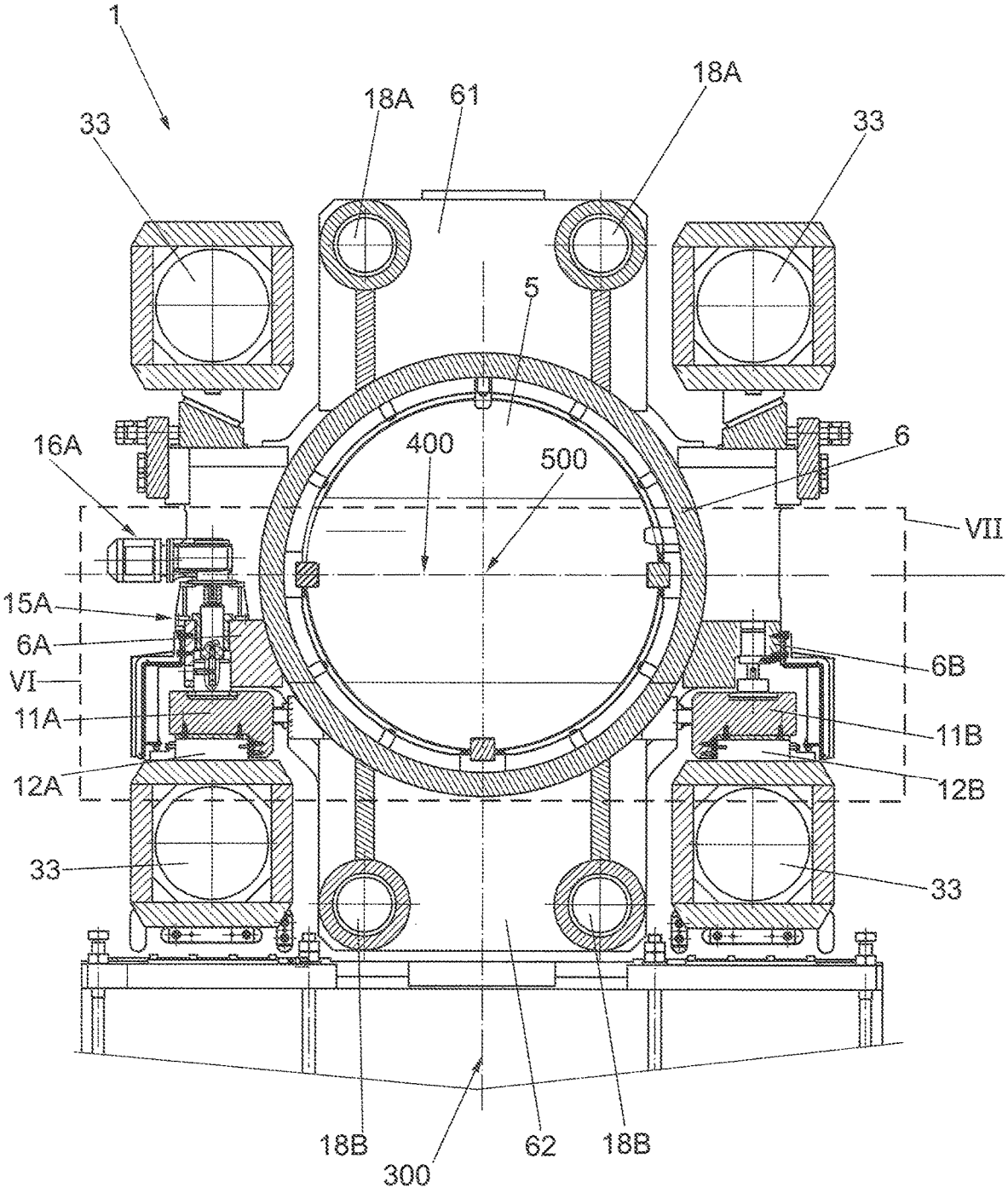
FIG. 5 is a section view taken along the sequence of planes having section IV-IV in FIG. 4.

With reference to FIGS. 4 to 8, the present invention relates to a press (generically indicated by reference numeral 1) for the extrusion of metallic material, particularly but not exclusively for the extrusion of aluminum. Press 1 comprises a supporting structure 10, which defines an extrusion direction 500 along which the metal material is extruded through a die 2. According to a principle known in itself, the die 2 confers the shape of the section of the metal profile generated by the extrusion.

The supporting structure 10 has a configuration known in itself comprising a first crosspiece 31, near which an extrusion die 2 is placed and a second crosspiece 32 in a position distanced from said die 2. The two crosspieces 31, 32 are connected by columns 33 which develop in parallel defining the extrusion direction 500. Press 1 comprises a thrust cylinder 200, integral with the second crosspiece 32, which generates the force necessary to extrude the material. In particular, the cylinder 200 moves a rod provided, at its free end, with a punch which acts on the material to be extruded, according to a widely known principle.

Press 1 comprises a container 5 inside which the metal material to be extruded is loaded. Preferably, the container 5 is defined by a cylindrical hollow body which contains the billet in a plastic state. The container 5 is supported by a container holder 6 which rests on a plurality of pads 11A, 11B, preferably two. These pads 11A, 11B slide along corresponding guides 12A, 12B fixed to the supporting structure 10 and parallel to the extrusion direction 500. Therefore, the container holder 6 also slides parallel to the extrusion direction 500.

Press 1 according to the invention further comprises a number of adjustment devices 15A, 15B to adjust the position of the container holder 6 with respect to the supporting structure 10. The adjustment devices 15A, 15B allow the adjustment of the position and orientation of the container holder 6 with respect to the pads 11A,11B or with respect to the guides 12A,12B. By means of such devices, it is possible to align the axis of the container with the extrusion direction 500.

According to the present invention, press 1 comprises at least one motorized member 16A, 16B which controls at least one of the adjustment devices 15A, 15B. In particular, in an activating condition, said motorized member 15A, 15B activates the adjustment device 15A, 15B so as to cause a controlled change in the position of container holder 6. Instead, in a deactivating, condition, the motorized member 16A, 16B intervenes on the adjustment device 15A, 15B locking it in the configuration previously reached after said activation.

According to the invention, said at least one motorized member 16A, 16B controls the corresponding adjustment device 15A, 15B as a function of the position detected by the sensor means. In particular, the motorized member 16A, 16B activates the adjustment device 15A, 15B to correct the position of the container holder 6 and to lock the adjustment device 15A, 15B upon completion of such a correction.

According to an embodiment, press 1 further comprises sensor means 91 configured, to detect the position of said container holder element 6 with respect to said supporting structure 10. Substantially, the sensor means 91 detect a distance between a predetermined point of the container holder 6 from one or more fixed points and generate an electrical signal characteristic of such a distance. Preferably, the sensor means 91 detect the vertical distance between a preset point on container holder 6 and one of the guides 12A, 12B.

According to a preferred embodiment, also depicted in the Figures, press 1 according to the invention comprises a plurality of motorized members 16A, 16B each of which controls a corresponding adjustment device 15A, 15B. Press 1 comprises a control unit (hereinafter also referred to as ECU) to which the motorized members 16A, 16B are electrically connected. The sensor means 91 are also operationally connected to the ECU. As specified in greater detail below, as a function of the signals sent by the sensor means 91, the ECU controls the various adjustment devices 15A, 15B to correct the position of container holder 6.

The presence of the ECU allows for a substantially automatic adjustment. Indeed, as soon as the sensor means 91 detect that the distance of the container holder 6 from the fixed reference points exceeds a preset value, the ECU can control the motorized members 16A, 16B to perform the correction. Preferably, the ECU will activate such a correction at the end of one step of extruding and before the beginning of the next one.

Alternatively, the adjustment of the position of the container holder 6 could be done semi-automatically. In such a case, the information coming from the sensor means 91 could activate signaling means which inform an operator of the need to implement the adjustment. Afterwards, the operator can activate the motorized members 16A,16B to activate the correction either directly or by means of the ECU.

According to a preferred embodiment, press 1 comprises two guides 12A,12B integral with the supporting structure 10. The two guides 12A,12B are specular with respect to a vertical reference plane 300 which contains the extrusion axis 500. A first pad 11A slides along a first guide 12A, while a second pad 11B slides along a second guide 12B. The sliding of the pads 11A, 11B along the corresponding guides 12A,12B is permitted by the use of bearings or bronze bushings according to a principle known in itself.

The container holder 6 is therefore supported by the pads 11A,11B. According to a possible embodiment the container holder 6 is moved by means of a plurality of cylinders 18A,18B connected thereto in order to apply a thrust uniformly distributed about the extrusion direction 500. In such regard, in the solution shown in FIG. 5, there are four thrust cylinders 18A,18B, of which the two upper cylinders 18A are specular with respect to the vertical reference plane 300 and are connected to an upper part 61 of the container holder 6. Two other lower cylinders 18B are specular with respect to the reference plane 300 and specular to the upper cylinders 18A with respect to a further horizontal reference plane 400. Such lower cylinders 18B are connected to a lower portion 62 of the container holder 6.

According to an embodiment of the invention, the plurality of adjustment devices comprises a first group of adjustment devices 15A interposed between a first pad 11A and the container holder 6 and a second group of adjustment devices 15B interposed between a second pad 116 and the container holder 6. More precisely, the adjustment devices 15A of the first group are interposed between the first pad 11A and a first side portion 6A of the container holder 6, while the adjustment devices 15B of the second group are interposed between the second pad 11B and a second side portion 6B of the container holder 6. The two side portions 6A,6B of the container holder 6 are defined by opposite parts with respect to the vertical reference plane 300 already indicated above. For the purposes of this invention, the term "interposed" means a condition such that the adjustment device 15A, 15B defines a resting point on a corresponding pad 11A, 11B for the container holder 6.

According to an embodiment, the first group comprises two adjustment devices 15A interposed between the first pad 11A and the first side portion 6A of the container holder 6. The two adjustment devices 15A, therefore, provide two resting points on the first pad 11A for the first side portion 6A. Preferably, the two adjustment devices 15A are each installed in a vicinal position at a corresponding end of the first pad 11A.

Figure 8:
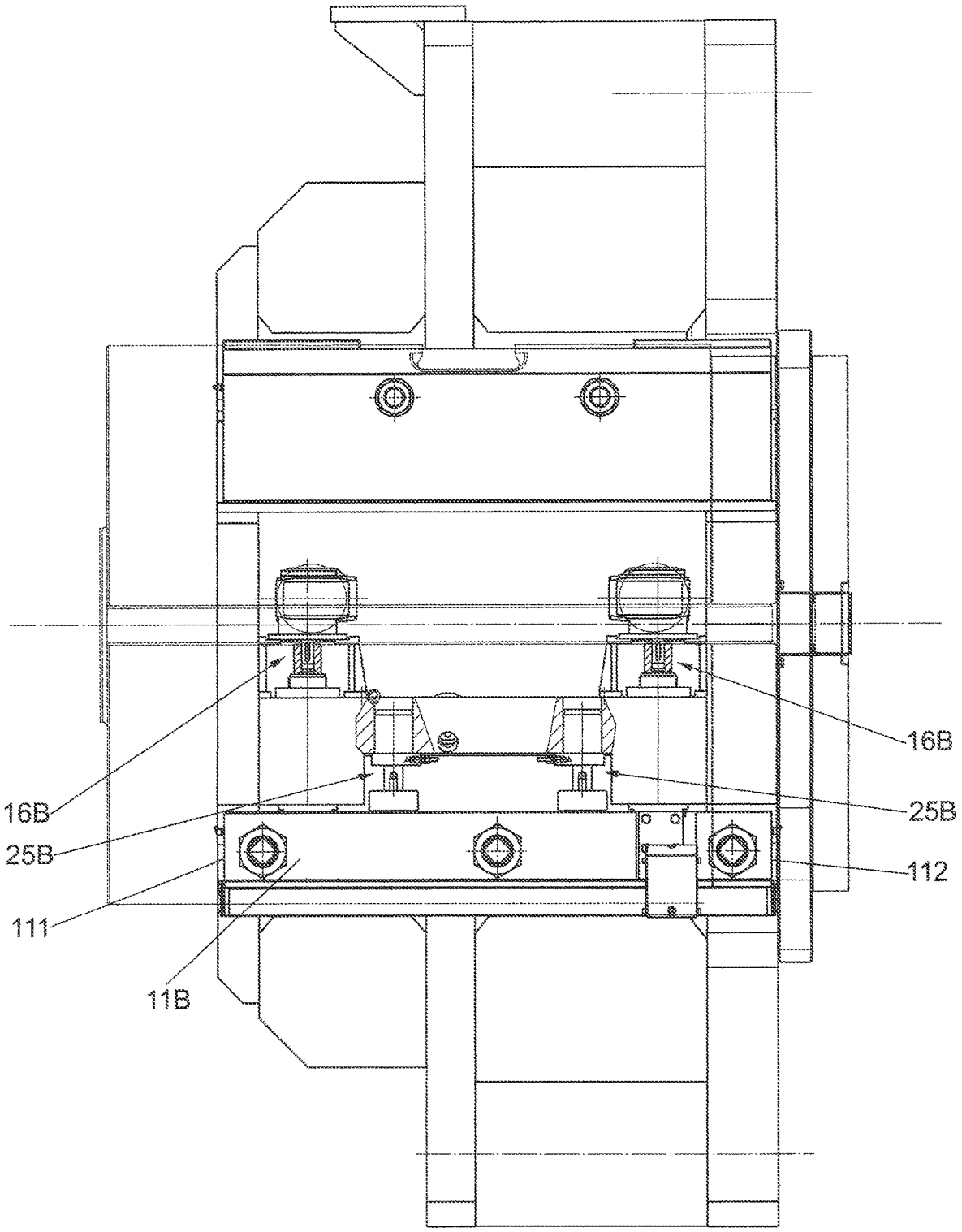
FIG. 8 is a partial side section view of the press in FIG. 4.

Similarly, the second group further comprises two adjustment devices 15B, each of which is placed in a vicinal position at a corresponding end 111, 112 of the second pad 116 (see FIG. 8).

Again, according to a preferred embodiment, the arrangement of the adjustment devices 15A of the first group is specular to that of the adjustment devices 15B of the second group with respect to the vertical reference plane 300 indicated above.

Figure 6:
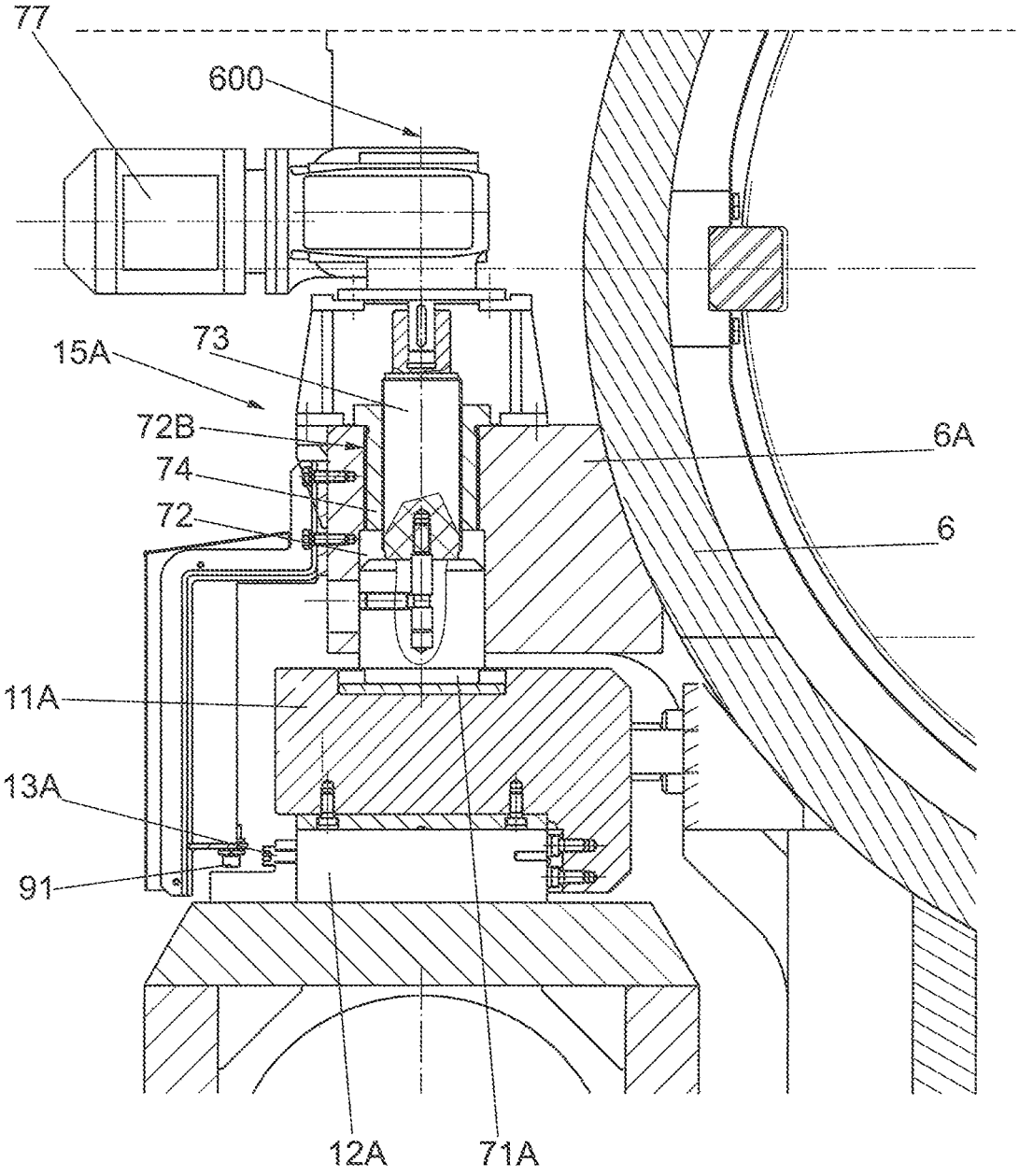
FIG. 6 is a view of detail VI-VI indicated in FIG. 5.

FIG. 6 illustrates a preferred embodiment of an adjustment device 15A of a press according to the invention. For the sake of simplicity of description only, the adjustment device 15A is shown in FIG. 6 as operationally interposed between the first pad 11A and the first side portion 6A of the container holder 6. However, this adjustment device may also be operationally interposed between the second pad 11B and the second side portion 6B of the container holder 6.

The adjustment device 15A comprises a lower body 71, preferably cylindrical, inserted in sliding manner into a through-hole 72, preferably cylindrical, defined by the first side portion 6A of the container holder 6. One end 71A protrudes from under the first side portion 6A to rest on the first pad 11A. Preferably, the diameter of the lower body 71 corresponds to that of the portion of the through cavity 72 within which it slides. In this manner, such a portion provides a guide for the lower body 71.

The adjustment device 15A further comprises an adjustment screw 73 attached to the lower body 71, preferably screwed to it through its lower end 71. The adjustment screw 73 is screwed into an internally hollow bushing 74, in turn externally screwed into a threaded upper portion 726 of the through-hole 72. Through the bushing 74, the adjustment screw 73 is therefore indirectly screwed to the upper threaded portion 72B remaining securely connected to the first portion 6A of the container holder 6. By effect of such a connection and by effect of the resting on the first pad 11A, a possible rotation of the adjustment screw 73 around its axis 600 results, according to the direction of rotation, in either lifting or lowering of the first portion 6A of the container holder 6 and thus in a variation of its spatial position. Such a rotation is carried out by means of the corresponding motorized member 16A operationally connected to the adjustment screw 73 of the adjustment device 15A.

According to an alternative embodiment, not depicted, the adjustment screw could be directly screwed to the upper threaded portion 72B of the through-hole 72.

According to an embodiment, the motorized member 16A which activates the adjustment device 15A consists of a geared motor 77 having irreversible behavior. This expression indicates a gearmotor provided with a transmission such as to develop a reduction gear ratio between a fast shaft, driven by a preferably electric motor, and a slow shaft connected to the pin of the regulating device. The expression "irreversible behavior" is intended to indicate a configuration of the gearmotor such that any external torque acting on the slow shaft is not transmitted to the fast shaft. The external torque may derive from stresses on the container holder 6 transmitted to the slow shaft through the pin of the adjustment device. The configuration of the transmission of the gearmotor is, therefore, such that it is not affected by external torques and therefore such that it prevents undesired rotations of the adjustment pin.

According to an alternative embodiment, the motorized member 16A may consist of a gearmotor having reversible behavior in which the motor of the gearmotor is provided with a parking brake. In practice, in this configuration, the gearmotor transmission is such that the fast shaft may be affected by any external torque acting on the slow shaft. However, the parking brake acting on the fast shaft locks it in the position reached at the end of adjustment, thereby also locking the entire transmission connected to it.

According to a further embodiment, the motorized member 16A could consist of a gearmotor having irreversible, behavior with the electric motor provided with a parking brake. In this case, the gearmotor would have the construction features of both solutions described above.

According to another aspect of the present invention, press 1 comprises a plurality of lifting devices 25A, 25B provided to lift the container holder 6 with respect to the sliding pads 1 during the adjustment, made by means of the adjustment devices 15A,15B. In detail, in an activating condition thereof, the lifting devices 25A, 25B act on the container holder 6 in order to prevent the weight of the container holder from weighing on the adjustment screw 73 during its rotation determined by the intervention of the corresponding motorized members 16A,16B. In this manner, the mechanical wear of the components which constitute the adjustment devices 15A,15B is slowed down. Preferably, but not exclusively, the lifting devices 25A, 25B are activated or deactivated at the same time.

According to a preferred embodiment, the plurality of the lifting devices comprises a first group of lifting devices 25A operatively associated with the first side portion 6A of the container holder 6 and a second group of lifting devices 25B operatively associated with the second side portion 6B of the container holder 6. Preferably, the first group comprises the same number of lifting devices as the second group. Furthermore, the lifting devices 25A of the first group are preferably arranged in a specular position to the lifting devices 25B of the second group with respect to the vertical reference plane 300 indicated above. In this manner, a condition of balance is defined for the forces supporting the container holder 6 during the adjustment.

According to a possible embodiment shown in FIG. 8, the lifting devices 25A of the first group and the lifting devices 25B of the second group are two in number and spatially interposed between the adjustment devices 15A,15B associated with the corresponding side portion 25A,25B.

Figure 7:
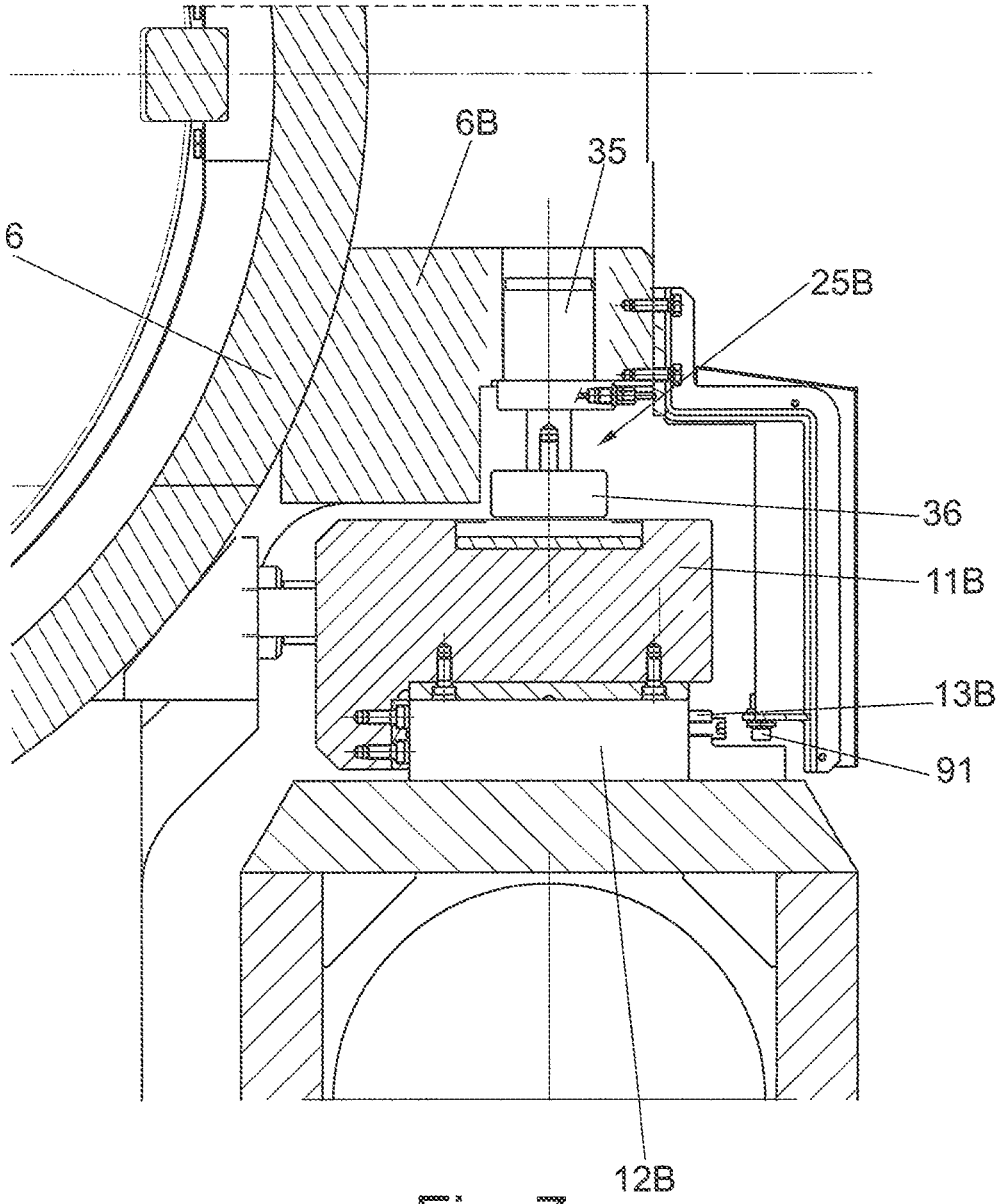
FIG. 7 is a view of detail VII-VII indicated in FIG. 5.

FIG. 7 shows a possible embodiment of a lifting device 25B operationally associated with the second side portion 6B of the container holder 6. It is worth noting that such a lifting device could also be associated with the first side portion 6A.

Therefore, with reference to FIG. 7, the lifting device 25B comprises a hydraulic cylinder 35 configured to move a piston 36 between a resting (or retracted) position and a working (or extended) position. When the lifting device 25B is activated, the hydraulic cylinder 35 moves the piston 36 from the resting position to the working position in which the piston 36 contacts the second pad 11B applying a reaction force on it which reduces the weight force of the container holder 6 weighing on the adjustment screws 73 of the adjustment devices 15A,15B.

As a whole, when activated, the lifting devices 25A,25B apply on the pads 11A,11B corresponding reaction forces in which the resultant force balances the weight force which would weigh on the adjustment screws 73 of the adjustment devices 15A,15B.

In this manner, the rotation of the adjustment screws 73, performed by means of the motorized components 16A,16B, is facilitated by not being affected by the weight of the assembly consisting of the container 5 and of the container holder 6.

Therefore, the lifting devices 25A, 25B are activated before the step of adjustment of the position of the container holder 6 or before the activation of the motorized components 16A,16B. During the extrusion process, the lifting devices 25A, 25B are deactivated. Preferably, the lifting devices 25A, 25B, and in particular the corresponding hydraulic cylinders 35, are controlled by means of solenoid valves electrically connected to the ECU which controls its operation.

As mentioned above, according to the signals sent by the sensor means, the ECU decides whether or not to correct the position of the container holder 6. Indeed, as indicated above, the sensor means send signals which are characteristic of the real distance of the container holder 6 from fixed points. The ECU controls that each of such values falls within a predetermined range of values characteristic of an acceptable condition for the alignment of the container holder 6 with the extrusion axis 500. If one or more of these values fall outside such a range, the ECU, by means of an appropriate algorithm, calculates by which quantity the adjustment screws 73 of each adjustment device must be turned to take the container holder 6 back to the correct alignment condition. Following the calculation of the rotation values for each screw, the ECU activates the corresponding motorized members 16A, 16B in order to perform such rotations. Preferably, before activating the motorized members 16A,16B, the ECU controls the activation of the lifting devices 25A,25B for the aforesaid purposes.

According to a possible embodiment, the press according to the invention comprises adjustment means to adjust the side position of the container holder 6. Such adjustment means are preferably associated with the pads 11A,11B and allow the position of the container holder 6 to be adjusted with respect to the vertical reference plane 300. These means essentially define abutment surfaces for container holder 6 in order to guide it along the extrusion direction 500.

In a possible embodiment thereof, such adjustment means comprise at least a first screw 13A and at least a second screw 13B associated with the first pad 11A and the second pad 11B, respectively. An element defining a corresponding abutment/supporting surface for container holder 6 is installed at the end of each screw. The axis of the screws 13A,13B is oriented in a direction substantially orthogonal to the vertical reference plane 300 above.

The present invention comprises the possibility that the side adjustment means of the container holder 6 comprise a first plurality of screws associated with the first pad 11A and a second plurality of screws associated with the second pad 11B, wherein such first and second plurality have the same number of screws and wherein the screws of said plurality are arranged in a specular position, with respect to the vertical reference plane 300, to the screws of said second plurality.

The screws 13A,13B can be manually operated in a possible embodiment of the side adjustment means. However, according to a preferred embodiment, press 1 can be provided with further motorized members specifically provided for the rotation of such screws 13A,13B. Preferably, said additional motorized members are electrically connected to the ECU which controls their activation according to the signals sent to it by further sensor means specifically designed to detect the real position of the container holder 6 with respect to the vertical reference plane 300.

Although the present invention is explained above by means of a detailed description of the embodiments thereof depicted in, the drawings, the present invention is not obviously limited to the embodiments described above and depicted in the drawings. On the contrary, all the modifications and/or variants of the embodiments described above and depicted in the drawings which will appear obvious and immediate to a person skilled in the art fall within the scope of the present invention.

The invention claimed is:

1. A press for the direct extrusion of metal material, wherein said press comprises:

a supporting structure which defines an extrusion direction of said metal material;

a container receiving the metal material to be extruded;

a container holder element which supports said container, wherein said container holder element is movable along an extrusion direction by a plurality of pads slidable along corresponding guides integral with the supporting structure;

a plurality of adjustment devices for adjusting the position of said container holder element with respect to said supporting structure, said press comprises at least one motorized member operatively connected to at least one of said adjustment devices, wherein in an activating condition, said motorized member activates said at least one adjustment device so as to cause a variation of the position of said container holder element with respect to said supporting structure and wherein, in a deactivating condition, said motorized member intervenes on said at least one adjustment device locking said at least one adjustment device in a position previously reached during said activation condition;

wherein said adjustment devices are operatively interposed between a corresponding pad of said plurality of pads and said container holder so that said adjustment devices define resting points on said sliding pads for said container holder;

wherein said press comprises a first pad and a second pad sliding along a first guide and a second guide, respectively, wherein said plurality of adjustment devices comprises a first group of adjustment devices operatively interposed between said first pad and a first side portion of said container holder and a second group of adjustment devices operatively interposed between said second pad and a second side portion of said container holder, wherein said guides are aligned with respect to a vertical reference plane containing said extrusion axis and wherein said side portions of said container holder are defined on opposite sides with respect to said vertical reference plane;

wherein said adjustment devices of said first group are arranged in an aligned position, with respect to said vertical reference plane, to the adjustment devices of said second group;

wherein at least one of said adjustment devices comprises:

a lower body slidably inserted in a through cavity defined by a portion of said container holder, in which one end of the lower body protrudes from said through cavity for resting on a pad of said plurality of pads;

an adjustment screw integral with said lower body, wherein said screw cooperates with a threaded portion of said through cavity so that a rotation of said adjustment screw determines a displacement of said portion of said container holder along a direction parallel to the axis of said adjustment screw, wherein said at least one motorized member is connected to said adjustment screw to rotate said adjustment screw about its axis.

2. The press according to claim 1, wherein said press comprises sensor means which detect the position of said container holder element with respect to said supporting structure.

3. The press according to claim 2, wherein said press comprises:

a plurality of motorized members, each operatively connected to a corresponding one of said adjustment devices;

a control unit (ECU) which controls said motorized means, wherein said sensor means and said motorized members are electrically connected to said control unit (ECU), and wherein said control unit (ECU) controls said motorized means as a function of a position detected by said sensor means.

4. The press according to claim 1, wherein said adjustment screw cooperates with a threaded portion of said through cavity by means of an internally hollow bushing, wherein said bushing is screwed onto said threaded portion of said through cavity and said adjustment screw is screwed inside said bushing.

5. The press according to claim 4, wherein said at least one motorized member comprises a gearmotor.

6. The press according to claim 4, wherein said at least one motorized member comprises a gearmotor with a locking brake.

7. The press according to claim 6, wherein said press comprises a plurality of lifting devices for applying a force to said container holder on said adjustment devices during their activation.

8. The press according to claim 7, wherein said plurality of lifting devices comprises a first group of devices, operatively associated with a first side portion of said container holder and a second group of devices operatively associated with a second side portion of said container holder, wherein said side portions of said container holder are defined on opposite sides with respect to said vertical reference plane and wherein the lifting devices of said first group are placed in an aligned position, with respect to said vertical reference plane, to the lifting devices of said second group.

9. The press according to claim 8, wherein at least one of said lifting devices comprises a hydraulic cylinder which moves a piston between a resting position and a working position, wherein upon activation of said lifting device, said piston reaches said working position exerting a reaction force to a pad of the said plurality of pads, which force reduces the weight of the container holder on said adjustment devices.

10. The press according to claim 9, wherein said lifting devices are activated before the activation of said adjustment devices.

11. The press according to claim 10, wherein said press comprises further adjustment means for adjusting a position of said container holder along a direction orthogonal to a vertical reference plane comprising said extrusion axis.

12. The press according to claim 11, wherein said press comprises at least one motorized members operatively connected to said adjustment devices for their activation.

* * * * *